US012546027B2

(12) United States Patent
Kobayashi et al.

(10) Patent No.: US 12,546,027 B2
(45) Date of Patent: Feb. 10, 2026

(54) ANODE FOR ELECTROPLATING, AND METHOD AND SYSTEM FOR ELECTROPLATING ARTICLES WITH METAL

(71) Applicant: Dipsol Chemicals Co., Ltd., Tokyo (JP)

(72) Inventors: Kota Kobayashi, Nagareyama (JP); Nobuya Sugaya, Nagareyama (JP)

(73) Assignee: Dipsol Chemicals Co., Ltd., Tokyo (JP)

( * ) Notice: Subject to any disclaimer, the term of this patent is extended or adjusted under 35 U.S.C. 154(b) by 0 days.

(21) Appl. No.: 18/713,164

(22) PCT Filed: Nov. 17, 2023

(86) PCT No.: PCT/JP2023/041431
§ 371 (c)(1),
(2) Date: May 23, 2024

(87) PCT Pub. No.: WO2024/111515
PCT Pub. Date: May 30, 2024

(65) Prior Publication Data

US 2024/0337041 A1 Oct. 10, 2024

(30) Foreign Application Priority Data

Nov. 25, 2022 (JP) ..... 2022-188611

(51) Int. Cl.
*C25D 17/12* (2006.01)
*C25D 3/22* (2006.01)

(52) U.S. Cl.
CPC ..... *C25D 17/12* (2013.01); *C25D 3/22* (2013.01)

(58) Field of Classification Search
None
See application file for complete search history.

(56) References Cited

U.S. PATENT DOCUMENTS 2,275,194 A 3/1942 Sizelove
4,134,806 A 1/1979 De Nora et al.
(Continued)

FOREIGN PATENT DOCUMENTS

DE 374113 C 5/1923
JP 49-105701 A 10/1974
(Continued)

OTHER PUBLICATIONS

English translation KR930008929 (Year: 1993).*
(Continued)

*Primary Examiner* — Stefanie S Wittenberg
(74) *Attorney, Agent, or Firm* — Foley & Lardner LLP

(57) ABSTRACT

The present invention aims to provide an anode for electroplating that can be relatively easily manufactured without the need for ancillary facilities or anolyte management, and without requiring expensive or special metals.
The present invention relates to an anode for electroplating, comprising:
an input part where power is input from a power source;
a pair of support parts that extend in a first direction, are arranged at intervals in a second direction intersecting the first direction, receive power supply from the input part, and whose portions in contact with a plating solution are covered with an insulating material; and
an electrification part that extends in the second direction, one end of which is connected to one of the pair of support parts, the other end of which is connected to the other of the pair of support parts, and receives power supply from the pair of support parts,
wherein the electrification part includes several current paths arranged at intervals in the first direction, and
a cross-sectional area of the electrification part is smaller than that of each of the support parts.

5 Claims, 6 Drawing Sheets

(56) References Cited

U.S. PATENT DOCUMENTS

| | | | | |
|---|---|---|---|---|
| 4,642,173 | A * | 2/1987 | Koziol | C25D 17/12 205/97 |
| 5,766,430 | A * | 6/1998 | Mehler | C25D 17/12 204/287 |
| 5,938,899 | A * | 8/1999 | Forand | C25D 17/12 204/288.2 |
| 2017/0022621 | A1 | 1/2017 | Niikura et al. | |
| 2017/0022625 | A1 | 1/2017 | Niikura et al. | |
| 2017/0298530 | A1 * | 10/2017 | Cheng | C25D 17/12 |
| 2019/0376200 | A1 | 12/2019 | Wohlfarth et al. | |
| 2020/0263314 | A1 | 8/2020 | Niikura et al. | |

FOREIGN PATENT DOCUMENTS

| | | | |
|---|---|---|---|
| JP | S5340641 | A | 4/1978 |
| JP | 01-208499 | A | 8/1989 |
| JP | 05-331696 | A | 12/1993 |
| JP | 09-003698 | A | 1/1997 |
| JP | 2019-530800 | A | 10/2019 |
| JP | 6582353 | B1 | 10/2019 |
| WO | WO 2016/075963 | A1 | 5/2016 |
| WO | WO 2016/075964 | A1 | 5/2016 |

OTHER PUBLICATIONS

English translation JP5340641 (Year: 1978).*
English translation CN 111101153 (Year: 2020).*
English translation CN 201420106 (Year: 2010).*
English translation JP 62196397 (Year: 1987).*
English translation WO 2016188806 (Year: 2016).*
Official Action of Japanese Patent Application No. 2022-188611 dispatched Jul. 13, 2023, 9 pages.
International Search Report and Written Opinion for PCT/JP2023/041431 dated Jan. 23, 2024, 11 pages, no translation available.
Extended European Search Report for European Application No. 23889861.3 dated Jun. 20, 2025, 9 pages.

* cited by examiner

*PRIOR ART*

| | APPEARANCE OF CATHODE |
|---|---|
| PLATING SOLUTION BEFORE ELECTRIFICATION |  |
| PLATING SOLUTION AFTER ELECTRIFICATION<br>EXAMPLE 3 |  |
| COMPARATIVE EXAMPLE 4 |  |

ANODE FOR ELECTROPLATING, AND METHOD AND SYSTEM FOR ELECTROPLATING ARTICLES WITH METAL

CROSS-REFERENCE TO RELATED APPLICATIONS

This application is the U.S. National Stage Application of International Application No. PCT/JP2023/041431, filed Nov. 17, 2023, which claims the benefit of and priority to Japanese Patent Application No. 2022-188611, filed Nov. 25, 2022, the entire contents of each of which is incorporated herein by reference in its entirety.

TECHNICAL FIELD

The present invention relates to an anode for electroplating, and a method and system for electroplating an article with a metal using the same, and particularly relates to an anode for electroplating where decomposition of organic compound additives added to a plating bath containing metal ions is suppressed, and a method and system for electroplating an article with a metal using the same.

BACKGROUND ART

Zinc plating is used as a relatively inexpensive anti-rust plating, and its alkaline plating bath uses organic compounds such as quaternary amine polymers as additives. When these organic compounds are decomposed by anodic oxidation, it causes the precipitation of poorly adhering dendrites, making it impossible to form a good zinc anti-rust plating.

Zinc alloy plating is widely used in automotive parts and the like due to its superior corrosion resistance compared to zinc plating. In particular, alkaline zinc-nickel alloy plating baths are used for fuel parts required to have high corrosion resistance and engine parts placed under high-temperature environments. Alkaline zinc-nickel alloy plating baths dissolve nickel using amine-based chelating agents suitable for the desired nickel co-deposition ratio, co-depositing zinc and nickel in the plating film; however, the problem arises when amine-based chelating agents are oxidatively decomposed on the anode surface during electrification, producing oxalic acid and sodium carbonate. In the presence of nickel ions and iron-based metal ions such as iron ions, these act as oxidation catalysts, further promoting the oxidative decomposition of amine-based chelating agents. As a result, amine-based chelating agents are rapidly decomposed when the alkaline zinc-nickel alloy plating bath comes into contact with the anode, leading to a rapid decline in plating performance. This accumulation of decomposition products causes many problems such as a decrease in current efficiency, an increase in bath voltage, a reduction in plating film thickness, a decrease in the nickel co-deposition ratio in the plating film, a narrowing of the plateable current density range, a decrease in gloss, and an increase in the chemical oxygen demand (COD). Therefore, it is necessary to frequently replace the plating bath, as it could not be used for a long period.

Patent Literatures 1 and 2 describe a so-called anode cell system that can suppress the decomposition of organic compound additives by placing anolyte in a cell covered with a diaphragm and partitioning it so as not to contact the plating bath with the anode plate. In this anode cell system, the effect of removing decomposition products from the plating bath is also expected, as oxalic acid and sodium carbonate generated in the plating bath move from the plating solution into the anode cell. However, the anode cell system requires many ancillary facilities such as the anode cell body, piping, and pumps. Furthermore, concentration management of the anolyte is necessary, and it needs to be replaced after a certain amount of electrification.

Patent Literature 3 describes suppressing the decomposition of organic compound additives by coating the surface of the anode's conductive substrate. In this case, there is no need for ancillary facilities or electrode solution management, but the cost of manufacturing the anode is a problem. Patent Literature 4 also describes coating the surface of the anode's conductive substrate, but further improvements are sought.

On the other hand, Patent Literature 5 describes using an electrode formed by providing an iridium oxide-based coating layer on a conductive substrate at a specific anodic current density for iron-based electroplating, to suppress the electrolytic oxidation of $Fe^{2+}$ ions in the plating bath; it is also described that the shape of the coating layer may be mesh-like. Furthermore, Patent Literature 6 describes a porous metal anode with a shape such as expanded metal, having a coating layer of electrode active materials such as iridium oxide; this electrode is not only lighter and easier to handle compared to conventional flat plate anodes but also effective in reducing voltage due to the ease of gas escape, among other things.

CITATION LIST

Patent Literatures

Patent Literature 1: International Publication No. WO2016/075963

Patent Literature 2: International Publication No. WO2016/075964

Patent Literature 3: Japanese Patent No. 6582353

Patent Literature 4: International Application Japanese-Phase Publication No. 2019-530800

Patent Literature 5: Japanese Patent Application Publication No. Hei 5-331696

Patent Literature 6: Japanese Patent Application Publication No. Hei 1-208499

SUMMARY OF INVENTION

Problems to be Solved by the Invention

The present invention aims to provide an anode for electroplating that can be relatively easily manufactured without the need for ancillary facilities or anolyte management, and without requiring expensive or special metals.

Means for Solution of the Problems

As a result of diligent investigation to solve the above-mentioned problems, the present inventors have found that, in an anode for electroplating, by providing a specific support part between the input part where current is input from the power source and the electrification part that electrifies the plating solution, it is possible to suppress the rise in bath voltage and the increase in bath temperature due to heating of the electrification part, thereby completing the present invention. That is, the present invention provides the following anode for electroplating, a method for electroplating an article with a metal, and a system for electroplating an article with a metal.

[1] An anode for electroplating, comprising:

an input part where power is input from a power source;

a pair of support parts that extend in a first direction, are arranged at intervals in a second direction intersecting the first direction, receive power supply from the input part, and whose portions in contact with a plating solution are covered with an insulating material; and an electrification part that extends in the second direction, one end of which is connected to one of the pair of support parts, the other end of which is connected to the other of the pair of support parts, and receives power supply from the pair of support parts, wherein the electrification part includes several current paths arranged at intervals in the first direction, and a cross-sectional area of the electrification part is smaller than that of each of the support parts.

[2] The anode for electroplating according to [1], wherein a ratio (Sc/So) of an area (Sc) of the portion of the electrification part in contact with the solution to an outer shape area (So) of a region where the electrification part is arranged is 0.05 to 0.5.

[3] The anode for electroplating according to [1] or [2], wherein a ratio ($S_2/S_1$) of a cross-sectional area ($S_2$) of the electrification part to a cross-sectional area ($S_1$) of each support part is 0.5 or less.

[4] The anode for electroplating according to any one of [1] to [3], wherein the electrification part includes wire, expanded metal, and/or punching metal.

[5] The anode for electroplating according to any one of [1] to [4], wherein the electrification part:

has a cross-sectional area ($S_2$) of 3 to 75 $mm^2$, and/or includes at least one selected from the group consisting of iron, nickel, stainless steel, and carbon, and/or is uniformly dispersed and arranged in the anode, and/or is arranged at intervals of 10 cm or less.

[6] The anode according to any one of [1] to [5], wherein the support part constitutes at least part of an outer periphery of the anode, and/or the cross-sectional area ($S_1$) of the support part is 15 to 1200 $mm^2$.

[7] A method for electroplating an article with metal, comprising:

electrifying in a plating bath containing ions of the metal and an organic compound additive, wherein the plating bath includes the article as a cathode and an anode for electroplating according to any one of [1] to [6].

[8] The method according to [7], wherein a magnitude of the current (anodic current density) relative to the area (Sc) of the portion of the electrification part in contact with the solution is 25 to 150 $A/dm^2$, and/or the magnitude of the current relative to the cross-sectional area ($S_2$) of the electrification part is 2 to 75 $A/mm^2$.

[9] A system for electroplating an article with a metal, comprising:

a plating bath containing ions of the metal and an organic compound additive, wherein the plating bath includes the article as a cathode and an anode for electroplating according to any one of [1] to [6].

Advantageous Effects of Invention

According to the present invention, by providing a pair of support parts between the input part and the electrification part of the anode for electroplating, where the support parts have a larger cross-sectional area than the electrification part and the portions in contact with the plating solution are covered with an insulating material, it is possible to suppress the rise in bath voltage. The anode for electroplating of the present invention does not require ancillary facilities or anolyte management, nor does it require expensive or special metals, thereby enabling cost reduction in electroplating.

DESCRIPTION OF EMBODIMENTS

Figure 1:
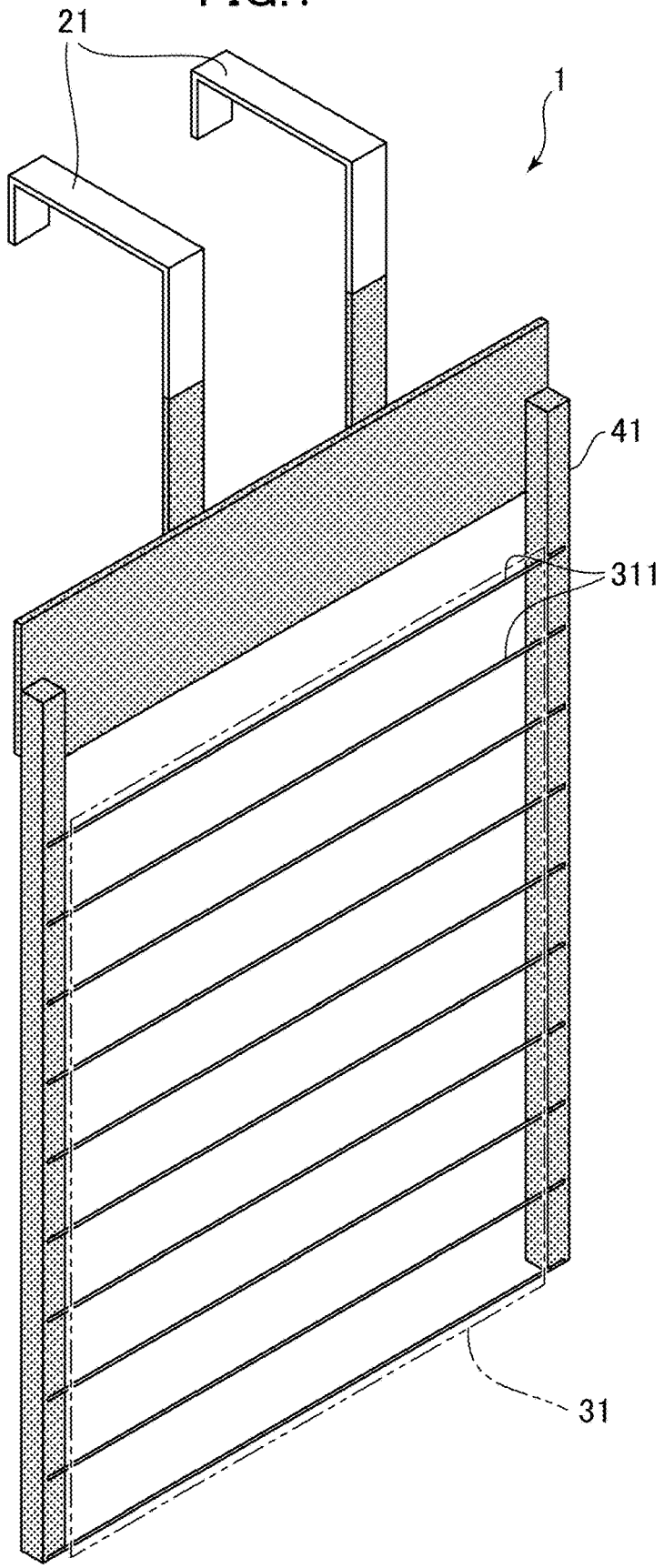
FIG. 1 illustrates one embodiment (ladder type) of the anode for electroplating according to the present invention. The hatched areas are covered with an insulating material.

Hereinafter, the present invention will be described in further detail.

The anode for electroplating of the present invention comprises:

an input part where power is input from a power source;

a pair of support parts that extend in a first direction, are arranged at intervals in a second direction intersecting the first direction, receive power supply from the input part, and whose portions in contact with a plating solution are covered with an insulating material; and an electrification part that extends in the second direction, one end of which is connected to one of the pair of support parts, the other end of which is connected to the other of the pair of support parts, and receives power supply from the pair of support parts, wherein a cross-sectional area of the electrification part is smaller than that of each of the support parts.

When attempting to increase the anodic current density with conventional simple flat electrodes, it is necessary to either reduce the outer shape area of the electrification part or apply a current greater than that required for plating. In the former case, the reduction in outer shape area causes uneven electrification areas in the plating bath, leading to uneven current distribution and a rise in bath voltage. Furthermore, heating at the boundary between the air and the plating solution also causes a rise in bath voltage. On the other hand, the support parts of the electrode for electroplating according to the present invention supply power to the electrification part but do not electrify the plating solution as their portions in contact with the plating solution are covered with an insulating material, making it less likely for heating at the boundary between the air and the plating solution and a rise in bath voltage to occur. The support parts can efficiently supply power to the electrification parts located far from the input part, i.e., the electrification parts penetrating deep into the plating solution. Thus, the electrification part can stably receive power supply even deep within the plating solution, and since it is entirely contained within the plating solution, heating is not a problem even if it is made of conductive members with a small cross-sectional area, and further, uneven current distribution in the bath does not occur due to its uniform dispersion. As a result, it is possible to electrify the plating solution (plating bath) uniformly and efficiently, enabling the formation of a good plating film on the articles to be electroplated. Here, "cross-sectional area" mentioned here refers to the area in a plane perpendicular to the direction of current flow.

The first direction in which the pair of support parts extend is not particularly limited and may be the direction extending from the input part. In addition, the second direction is not particularly limited as long as it intersects the first direction and may be perpendicular to the first direction. Further, the pair of support parts may be separated parts on a continuous member or parts on separate members existing at a distance from each other, and their specific embodiments are not particularly limited as long as they can connect the electrification part in between. In one embodiment, the pair of support parts may constitute at least part of the outer periphery of the anode and may encircle the entire periphery. That is, the anode for electroplating according to the present invention may further include additional support parts, and the pair of support parts and the additional support parts may be directly or indirectly connected to form part or all of the outer periphery of the anode, forming a frame.

The cross-sectional area ($S_1$) of the support parts is not particularly limited but may be, for example, about 15 $mm^2$ to about 1200 $mm^2$, about 100 $mm^2$ to about 1100 $mm^2$, or about 125 $mm^2$ to about 1000 $mm^2$. Also, the conductive members constituting the support parts are not particularly limited as long as they can conduct electricity and may include at least one selected from the group consisting of iron, nickel, stainless steel, carbon, titanium, copper, and members coated with these materials.

The insulating material is not particularly limited as long as it can withstand use in the plating solution and may include at least one selected from the group consisting of polymer resins, rubber, insulating inorganic oxides, insulating inorganic nitrides, insulating inorganic carbides, and insulating inorganic borides. More specifically, the polymer resins may include epoxy resin, polyvinyl chloride, melamine resin, phenol resin, fluororesin, acrylic resin, polystyrene, ABS (acrylonitrile-butadiene-styrene) resin, polyethylene, polypropylene, nylon, polyurethane, methylpentene resin, or polycarbonate; the rubber may include silicone rubber, fluoro-rubber, urethane rubber, acrylic rubber, nitrile rubber, ethylene-propylene rubber, styrene rubber, butyl rubber, butadiene rubber, or natural rubber; and the insulating inorganic oxides may include silicon dioxide, magnesium oxide, zinc oxide, beryllium oxide, titanium oxide, or tantalum oxide.

The electrification part of the anode for electroplating according to the present invention has several current paths arranged at intervals in the first direction. Here, "current paths" mentioned here refer to the paths through which current flows, and several current paths may be formed by installing multiple conductive members constituting the electrification part or by constructing the conductive members constituting the electrification part to include a branching structure. In one embodiment, the several current paths are uniformly dispersed and arranged within the anode.

The fact that individual current paths are arranged at intervals means that voids are formed in the region where the electrification part exists, so that the total area of the portion of the entire electrification part in contact with the solution is smaller than the area of the portion in contact with the solution if all the electrification parts were assumed to be a series of flat plates, i.e., smaller than the outer shape area of the region where the electrification part is arranged. The ratio (Sc/So) of the area (Sc) of the portion of the electrification part in contact with the solution to the outer shape area (So) of the region where the electrification part is arranged is not particularly limited but may be, for example, about 0.5 or less, about 0.3 or less, or about 0.25 or less, and may be about 0.05 or more, 0.1 or more, or 0.125 or more.

Without being bound by any particular theory, it is considered that near the anode, oxidation reactions cause simultaneous occurrence of oxygen generation reactions and the decomposition reactions of the organic compound additive described later; limiting the area of the electrification part in the plating solution on the electrode increases the anodic current density (current per unit area of the electrification part of the anode), and in this state, compared to when the anodic current density is low, the oxygen generation reaction occurs preferentially over the decomposition reaction of the organic compound additive, leading to the suppression of the decomposition of the organic compound additive. Furthermore, it is considered that having the current paths arranged at intervals in the anode can suppress the rise in plating bath voltage and keep stable current distribution to the cathode. If a conventional flat plate is used as the anode and an attempt is made to increase the anodic current density without changing the area of the electrification part, it would be necessary to significantly increase the applied current, which would also raise the bath voltage, making it uneconomical and potentially affecting the durability of the anode. Moreover, significantly increasing the applied current would also significantly increase the cathodic current density, potentially adversely affecting the plating quality. Using the anode for electroplating according to this embodiment allows increasing the anodic current density without these disadvantages and can suppress the decomposition of the organic compound additive.

The cross-sectional area ($S_2$) of the electrification part of the anode for electroplating according to the present invention is not particularly limited as long as it is smaller than the cross-sectional area of the support part but may be, for example, about 3 $mm^2$ to about 75 $mm^2$, or about 4.5 $mm^2$ to about 50 $mm^2$. The ratio ($S_2/S_1$) of the cross-sectional area ($S_2$) of the electrification part to the cross-sectional area ($S_1$) of the support part is not particularly limited but may be, for example, about 0.5 or less, about 0.004 to about 0.25, or about 0.007 to about 0.16.

The conductive members constituting the electrification part are not particularly limited as long as they can conduct electricity and may include at least one selected from the group consisting of iron, nickel, stainless steel, carbon, platinum, platinum-coated titanium, palladium-tin alloy, and members coated with these materials, preferably including at least one selected from the group consisting of iron, nickel, stainless steel, and carbon. The shape of the electrification part is not particularly limited but may be, for example, wire, expanded metal, punching metal, and/or flat plate, preferably wire. Expanded metal and punching metal can form several current paths even when used alone due to their branching structure.

In one embodiment, the anode for electroplating according to the present invention may have multiple electrification parts arranged, and the multiple electrification parts are preferably uniformly dispersed and arranged within the anode. The interval at which they are arranged is not particularly limited but, for example, the electrification parts may be arranged at intervals of about 10 cm or less, or about 3 cm to about 7 cm, based on the distance between their centers. In another embodiment, the anode for electroplating according to the present invention may further include electrification parts extending in the first direction. The electrification parts extending in the first direction are not particularly limited but may have several current paths arranged at intervals in the second direction.

Figure 2:
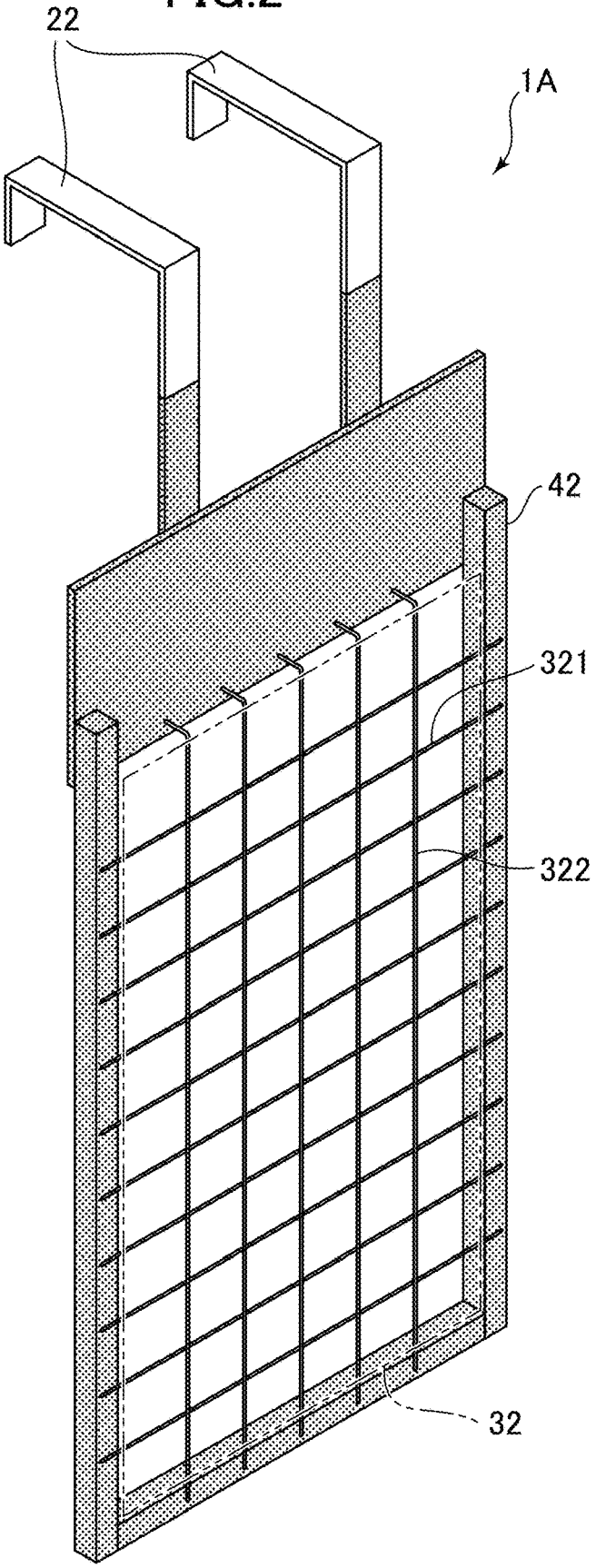
FIG. 2 illustrates one embodiment (grid type) of the anode for electroplating according to the present invention. The hatched areas are covered with an insulating material.

The manner in which the electrification part is connected to the support part in the anode for electroplating according to the present invention is not particularly limited as long as they can conduct electricity to each other but, for example, may be configured with the input part 21 at the top and the support part 41 (frame) surrounding the periphery of the electrode except for the lower side, with the electrification part 31 arranged in a ladder-like manner between both sides of the support part 41 (ladder-type anode for electroplating 1). In this case, several current paths 311 are provided in a direction perpendicular to the support part 41. Alternatively, with the input part 22 at the top and the support part 42 (frame) configured to surround the entire periphery of the electrode, the electrification part 32 may be arranged in a grid-like manner inside the support part 42 (grid-type anode for electroplating 1A). In this case, several current paths 321 are provided not only in the direction perpendicular to the support part 42 but also in the direction in which the support part 42 extends. An example of a ladder-type anode for electroplating with the electrification part shaped as wire is illustrated in FIG. 1, and an example of a grid-type anode for electroplating with the electrification part and the additional electrification part shaped as wire is illustrated in FIG. 2.

The anode for electroplating according to the present invention, as long as its purpose is not impaired, may be subjected to any modification commonly used in the technical field, or treatments useful for suppressing the rise in bath voltage, suppressing the increase in bath temperature due to heating of the electrification part, or suppressing the decomposition of the organic compound additive. For example, covering part of the surface of the conductive members constituting the electrification part with an insulating material while leaving other parts exposed can limit the area of the electrification part in the plating solution on the electrode, increase the anodic current density (current per unit area of the electrification part of the anode), and be useful for suppressing the decomposition of the organic compound additive.

In another embodiment, the present invention also relates to a method for electroplating an article with metal, wherein the method comprises:

electrifying in a plating bath containing ions of the metal and an organic compound additive, wherein the plating bath includes the article as a cathode and is equipped with the anode for electroplating described above according to the present invention.

According to the method of the present invention, it is possible to electrify the plating bath uniformly and efficiently while suppressing the rise in bath voltage and the increase in bath temperature due to heating of the electrification part, thereby forming a good plating film on the article.

The metal is not particularly limited as long as it is used for electroplating, for example, the metal may include zinc, nickel, iron, copper, cobalt, tin, and manganese. If the metal is solely zinc, a zinc film is formed on the article; if the metal includes zinc and other metals, a zinc alloy film is formed on the article. The other metals are not particularly limited as long as they can form a zinc alloy film, for example, they may be at least one selected from the group consisting of nickel, iron, cobalt, tin, and manganese. The zinc alloy film is not particularly limited, for example, it may be zinc-nickel alloy plating, zinc-iron alloy plating, zinc-cobalt alloy plating, zinc-manganese alloy plating, or tin-zinc alloy plating.

The article is an object to be plated and can be any commonly used in the technical field without particular limitation. The article may be various metals and their alloys such as iron, nickel, copper, zinc, aluminum, etc. Its shape is also not particularly limited, for example, it can be plate-shaped objects such as steel plates and plated steel plates, or shaped objects such as rectangular solids, cylinders, hollowed cylinders, spherical objects, etc. Specifically, it can be fastening parts such as bolts, nuts, and washers, pipe parts such as fuel pipes, cast iron parts such as brake calipers and common rails, as well as various objects such as connectors, plugs, housings, lamp bases, seat belt anchors, etc.

The conditions of the electrification step are not particularly limited as long as the metal plating film can be applied to the article, for example, electrification may be performed at a temperature of about 15° C. to about 40° C., preferably about 25° C. to about 35° C., or at a cathodic current density of about 0.1 to 20 A/dm$^2$, preferably 0.2 to 10 A/dm$^2$. The magnitude of the current (anodic current density) relative to the area (Sc) of the portion of the electrification part in contact with the solution is not particularly limited, for example, it may be about 25 to about 150 A/dm$^2$, preferably about 25 to about 75 A/dm$^2$, further preferably about 30 to about 65 A/dm$^2$. The magnitude of the current relative to the cross-sectional area ($S_2$) of the electrification part is not particularly limited, for example, it may be about 2 to about 75 A/mm$^2$, preferably about 5 to about 20 A/mm$^2$.

The "organic compound additive" mentioned in the present specification refers to organic compounds added to the plating bath for electroplating. The type of organic compound additive is not particularly limited, for example, in the case of zinc plating, the organic compound additive may be at least one selected from the group consisting of brighteners, water quality adjusters, and defoaming agents, and in the case of zinc alloy plating, the organic compound additive may be at least one selected from the group consisting of brighteners, metal complexing agents, water quality adjusters, and defoaming agents. In either case, in a preferable embodiment, the organic compound additive includes a brightener.

The brightener can be any commonly used in the technical field without particular limitation, for example, it may include base component brighteners that mainly contribute to the coating power and uniform electrodepositability of the plating film, gloss component brighteners that mainly directly contribute to the gloss of the plating film, and auxiliary component brighteners that mainly assist in gloss provision in low current density areas.

The base component brighteners are not particularly limited, for example, they may include (1) nonionic surfactants such as polyoxyethylene polyoxypropylene block polymers and acetylene glycol EO adducts, and anionic surfactants such as polyoxyethylene lauryl ether sulfate and alkyl diphenyl ether disulfonate salts; (2) poly(allyl amines) such as copolymers of diallyldimethylammonium chloride and sulfur dioxide; polyepoxypolyamines such as condensation polymers of ethylenediamine with epichlorohydrin, condensation polymers of dimethylaminopropylamine with epichlorohydrin, condensation polymers of imidazole with epichlorohydrin, condensation polymers of imidazole derivatives like 1-methylimidazole or 2-methylimidazole with epichlorohydrin, and condensation polymers of heterocyclic amines including triazine derivatives such as acetoguanamine and benzoguanamine with epichlorohydrin; polyamine-polyurea resins such as condensation polymers of 3-dimethylaminopropylurea with epichlorohydrin and condensation polymers of bis(N,N-dimethylaminopropyl) urea with epichlorohydrin, and polyamidopolyamines such as water-soluble nylon resins, including condensation polymers of N,N-dimethylaminopropylamine, alkylenedicarboxylic acid, and epichlorohydrin; polyalkylenepolyamines such as condensation polymers of diethylenetriamine or dimethylaminopropylamine with 2,2'-dichlorodiethyl ether, condensation polymers of dimethylaminopropylamine and 1,3-dichloropropane, condensation polymers of N,N,N',N'-tetramethyl-1,3-diaminopropane and 1,4-dichlorobutane, condensation polymers of N,N,N',N'-tetramethyl-1,3-diaminopropane and 1,3-dichloropropan-2-ol; and other polyamine compounds; (3) condensation polymers of dimethylamine and the like with dichloroethyl ether; (4) aromatic carboxylic acids such as benzoic acid or its salts; (5) quaternary ammonium salts not having a nitrogen-containing heterocycle such as cetyltrimethylammonium chloride; or nitrogen-containing heterocyclic quaternary ammonium salts.

The nitrogen-containing heterocyclic quaternary ammonium salts may be, for example, nitrogen-containing heterocyclic quaternary ammonium salts having a carboxy group and/or a hydroxy group. The nitrogen-containing heterocycle of the nitrogen-containing heterocyclic quaternary ammonium salts is not particularly limited, for example, it may be a pyridine ring, piperidine ring, imidazole ring, imidazoline ring, pyrrolidine ring, pyrazole ring, quinoline ring, or morpholine ring, preferably a pyridine ring. More preferably, the nitrogen-containing heterocyclic quaternary ammonium salts are quaternary ammonium salts of nicotinic acid or its derivatives. In the nitrogen-containing heterocyclic quaternary ammonium salt compounds, the carboxy group and/or hydroxy group may be directly bonded to the nitrogen-containing heterocycle or may be bonded through another substituent such as a carboxymethyl group. The nitrogen-containing heterocyclic quaternary ammonium salts may have additional substituents other than the carboxy group and hydroxy group, such as an alkyl group. Additionally, in the nitrogen-containing heterocyclic quaternary ammonium salts, the N substituents forming the quaternary ammonium cation are not particularly limited as long as they do not hinder the effect as a brightener, for example, they may be a substituted or unsubstituted alkyl group, aryl group, or alkoxy group. The counter anion forming the salt is not particularly limited, for example, it may be a compound including a halogen anion, oxyanion, borate anion, sulfonate anion, phosphate anion, or imide anion, preferably a halogen anion. Such quaternary ammonium salts are preferable because they contain both a quaternary ammonium cation and an oxyanion within the molecule, thus exhibiting behavior as an anion.

Specifically, the nitrogen-containing heterocyclic quaternary ammonium salts may be, for example, pyridinium, N-benzyl-3-carboxypyridinium chloride, N-phenethyl-4-carboxypyridinium chloride, N-butyl-3-carboxypyridinium bromide, N-chloromethyl-3-carboxypyridinium bromide, N-hexyl-6-hydroxy-3-carboxypyridinium chloride, N-hexyl-6-3-hydroxypropyl-3-carboxypyridinium chloride, N-2-hydroxyethyl-6-methoxy-3-carboxypyridinium chloride, N-methoxy-6-methyl-3-carboxypyridinium chloride, N-propyl-2-methyl-6-phenyl-3-carboxypyridinium chloride, N-propyl-2-methyl-6-phenyl-3-carboxypyridinium chloride, N-benzyl-3-carboxymethylpyridinium chloride, 1-butyl-3-methyl-4-carboxyimidazolium bromide, 1-butyl-3-methyl-4-carboxymethylimidazolium bromide, 1-butyl-2-hydroxymethyl-3-methylimidazolium chloride, 1-butyl-1-methyl-3-methylcarboxypyrolidinium chloride, or 1-butyl-1-methyl-4-methylcarboxypiperidinium chloride, etc. The nitrogen-containing heterocyclic quaternary ammonium salts may be used alone or in combination of two or more types.

The concentration of the base component brighteners in the plating bath is not particularly limited, for example, in the case of aromatic carboxylic acids, it may be about 1 to about 500 mg/L, preferably about 5 to about 100 mg/L, and in other cases, it may be about 0.01 to about 10 g/L, preferably 0.02 to 5 g/L.

The gloss component brighteners are not particularly limited, for example, they may include aromatic aldehydes such as veratraldehyde, vanillin, and anisaldehyde. The concentration of the gloss component brighteners in the plating bath is not particularly limited, for example, it may be about 1 to about 500 mg/L, preferably about 5 to about 100 mg/L.

The auxiliary component brighteners are not particularly limited, they may include thiouracil compounds, 2-mercaptobenzimidazole, and other mercapto compounds, as well as organic acids. The concentration of the auxiliary component brighteners in the plating bath is not particularly limited, for example, it may be about 0.01 to about 50 g/L.

The water quality adjuster can be any commonly used in the technical field without particular limitation, for example, it may include silicates. The concentration of the water quality adjuster in the plating bath is not particularly limited, for example, it may be about 0.01 to about 50 g/L. The defoaming agent can be any commonly used in the technical field without particular limitation, for example, surfactants may be employed, among other things. The concentration of the defoaming agent in the plating bath is not particularly limited, for example, it may be about 0.01 to about 5 g/L.

The metal complexing agent can be any commonly used in the technical field without particular limitation, for example, it may include amine-based chelating agents. For example, the amine-based chelating agents may include alkylene amine compounds such as ethylenediamine, diethylenetriamine, triethylenetetramine, tetraethylenepentamine, and pentaethylenehexamine; alkylene oxide adducts of the alkylene amines, such as ethylene oxide adducts and propylene oxide adducts; amino alcohols such as ethanolamine, diethanolamine, triethanolamine, diisopropanolamine, triisopropanolamine, ethylenediaminetetra-2-propanol, N-(2-aminoethyl) ethanolamine, and 2-hydroxyethylaminopropylamine; alkanolamine compounds such as N-(2-hydroxyethyl)-N,N',N'-triethyl ethylenediamine, N,N'-di(2-hydroxyethyl)-N,N'-diethyl ethylenediamine, N,N,N',N'-tetrakis(2-hydroxyethyl) propylenediamine, and N,N,N',N'-tetrakis(2-hydroxypropyl)ethylenediamine; poly(alkyleneimines) obtained from ethyleneimine and 1,2-propyleneimine; poly(alkyleneamines) obtained from ethylenediamine and triethylenetetramine; poly(amino alcohols), etc. Preferably, the metal complexing agent may include at least one selected from the group consisting of alkylene amine compounds, their alkylene oxide adducts, and alkanolamine compounds. The metal complexing agent may be used alone or in combination of two or more types. The concentration of the metal complexing agent in the plating bath is not particularly limited, for example, it may be about 5 to about 200 g/L, preferably about 30 to about 100 g/L.

The method of the present invention may further include any process commonly used in the technical field as long as it does not impair its purpose. For example, the method of the present invention may further include cleaning the article before the electrification step, or cleaning the article after the electrification step.

In another embodiment, the present invention relates to a system for electroplating an article with a metal, wherein the system includes:

a plating bath containing ions of the metal and an organic compound additive, wherein the plating bath includes the article as a cathode and is equipped with the anode for electroplating described above according to the present invention.

According to the system of the present invention, it is possible to electrify the plating bath uniformly and efficiently while suppressing the rise in bath voltage and the increase in bath temperature due to heating of the electrification part, thereby forming a good plating film on the article.

The specific embodiments of the system of the present invention are as described in detail regarding the method for electroplating according to the present invention. The system of the present invention may further include any equipment commonly used in the technical field as long as it does not impair its purpose.

Hereinafter, the present invention will be specifically described by Examples, but the scope of the present invention is not limited to these Examples.

EXAMPLES

Manufacturing Example 1

A U-shaped iron frame (height 620 mm×width 110 mm (inner width 80 mm), cross-sectional area 225 $mm^2$) with the bottom open was used as the support part, and 19 iron wires (diameter 2.5 mm) were attached horizontally (in a ladder-like manner) at intervals of 30-31 mm (the distance from the first to the nineteenth wire is 550 mm). A member (input part) to be in contact with the power connection part was attached to the top of the iron frame. Then, only the iron frame part was coated with a masking paint MR-54 (manufactured by TOKAN Corporation Co., Ltd.) containing styrene-based butadiene rubber (insulating material) to manufacture the anode for electroplating of Example 1. This anode electrifies through the iron wire part (electrification part; width 80 mm), and when installed along the wall of the electrolytic cell so that the entire anode is immersed in the electrolyte, the area of the portion in contact with the solution (the surface area of the iron wire excluding the wall side: Sc) is calculated to be 0.6 $dm^2$ (=0.025 dm×3.14×0.8 dm×½×19). On the other hand, since the outer shape area of the portion in contact with the solution of this anode (the outer shape area of the region where the iron wires are located: So) is calculated to be 4.4 $dm^2$ (=5.5 dm×0.8 dm), Sc/So is calculated to be 0.14. Also, the ratio ($S_2/S_1$) of the cross-sectional area ($S_2$) of the iron wire in the direction of current flow to the cross-sectional area ($S_1$) of the iron frame is calculated to be 0.022.

Test Example 1

An electrolytic cell containing an electrolyte with the composition listed in Table 1 was equipped with the anode for electroplating of Example 1, installed along the wall of the electrolytic cell so that the entire iron wire, the electrification part, was immersed in the electrolyte.

TABLE 1

Composition of Electrolyte

| Component | Concentration |
|---|---|
| $NiSO_4 \cdot 6H_2O$ | 7.3 g/L (1.6 g/L as Ni ions) |
| Caustic Soda | 130 g/L |
| IZ-250YB*[1] | 60 g/L |

*[1]Amine-based chelating agent manufactured by DIPSOL CHEMICALS CO., LTD. (ethylene oxide adduct of alkylene amine)

Similarly to the anode for electroplating of Example 1, an iron plate with the same outer shape area (height 550 mm×width 80 mm; both outer shape area and the area of the portion in contact with the solution were 4.4 $dm^2$) or an iron plate with the same area of the portion in contact with the solution (height 550 mm×width 11 mm; both outer shape area and the area of the portion in contact with the solution were 0.6 $dm^2$) as that of the anode was installed in the electrolytic cell as the anode of Comparative Examples 1 or 2, respectively. Then, acid-washed steel plates (SPHC-P steel plates) were installed as cathodes in each electrolytic cell, and electrification was performed under the conditions listed in Table 2. During electrification, the electrolytic cell was placed in a larger water tank, and the surroundings of the electrolytic cell were cooled with cooling water and a cooler to maintain the bath temperature.

TABLE 2

Electrification Conditions

| Item | Value |
|---|---|
| Current Value [A] | 35 |
| Anodic Current Density [A/$dm^2$] | Example 1: 58<br>Comparative Example 1: 8<br>Comparative Example 2: 58 |
| Bath Volume [L] | 2.5 |
| Electrification Time [h] | 8.9 |
| Bath Temperature [° C.] | 25 |

Before and after electrification, 30 mL of electrolyte was collected each time. Then, the concentration of IZ-250YB was measured by ion chromatography. In addition, the bath voltage immediately after the start of electrification and the bath temperature during electrification were also measured. The results are presented in Table 3.

TABLE 3

Test Results

| | IZ-250YB | | Bath | Bath |
|---|---|---|---|---|
| | Concentration [g/L] | Reduction Rate [%] | Voltage [V] | Temperature [° C.] |
| Before Electrification | 60 | — | — | 25 |
| After Electrification in Example 1 | 45 | 25 | 3.9 | 25 |

TABLE 3-continued

| Test Results | | | | |
|---|---|---|---|---|
| | IZ-250YB | | Bath | Bath |
| | Concentration [g/L] | Reduction Rate [%] | Voltage [V] | Temperature [° C.] |
| After Electrification in Comparative Example 1 | 30 | 50 | 3.7 | 25 |
| After Electrification in Comparative Example 1 | 45 | 25 | 4.9 | Note*2 |

*2The bath temperature rose to 31° C. 1 hour after the start of electrification, and thus electrification was stopped for 10 minutes until it cooled to 25° C. This operation was repeated while continuing electrification.

When using the anode of Comparative Example 1, which consists of a single iron plate, the chelating agent IZ-250YB was decomposed; however, when using the anode of Example 1, which uses multiple iron wires as the electrification part to reduce the area of the portion in contact with the solution (electrification part for the electrolyte) and is equipped with an insulating-coated frame with a larger cross-sectional area than the iron wires as the support part, the decomposition of IZ-250YB was suppressed. On the other hand, when using the anode of Comparative Example 2, which consists of a smaller single iron plate, the decomposition of IZ-250YB was successfully suppressed, but the bath voltage rose higher than in Comparative Example 1, and the cooling method adopted in this test could not maintain the bath temperature. Therefore, if the anode has the same outer shape area, separating and arranging multiple conductive members as electrification parts using the support part can suppress the decomposition of the organic compound additive without raising the bath voltage and bath temperature.

Manufacturing Example 2

Figure 3:
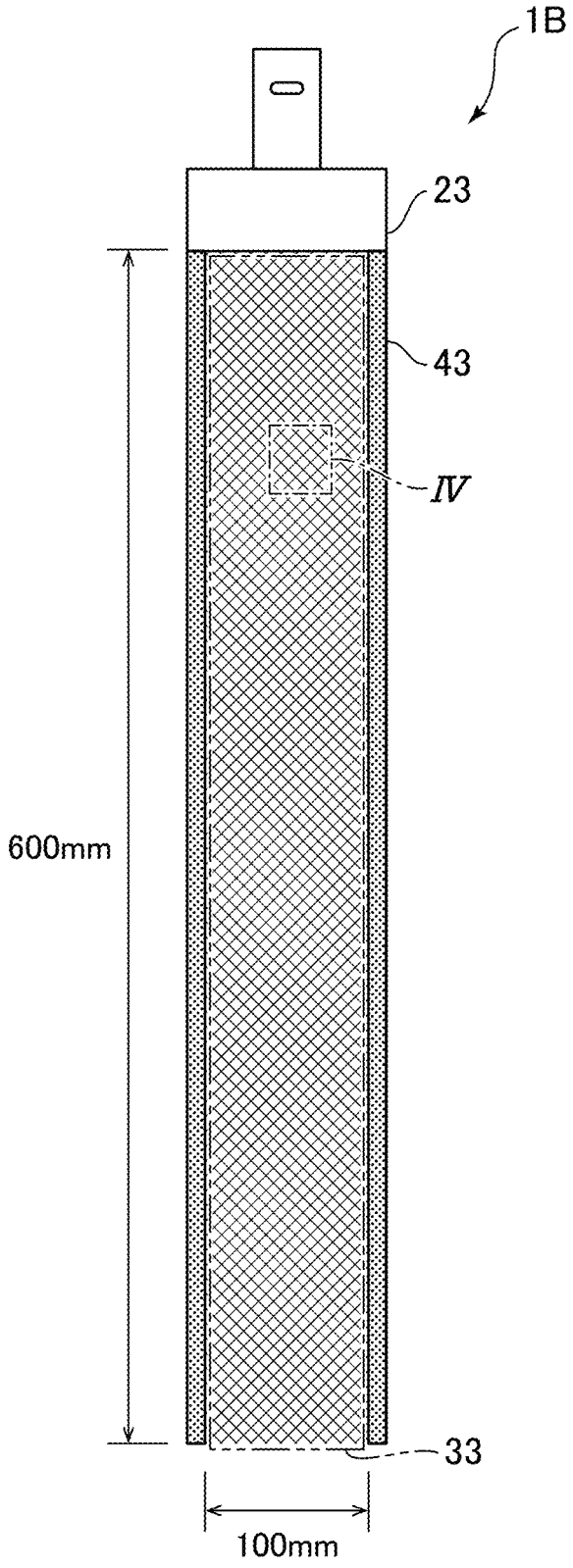
FIG. 3 illustrates one embodiment (mesh type) of the anode for electroplating according to the present invention. The hatched areas are covered with an insulating in material.
Figure 4:
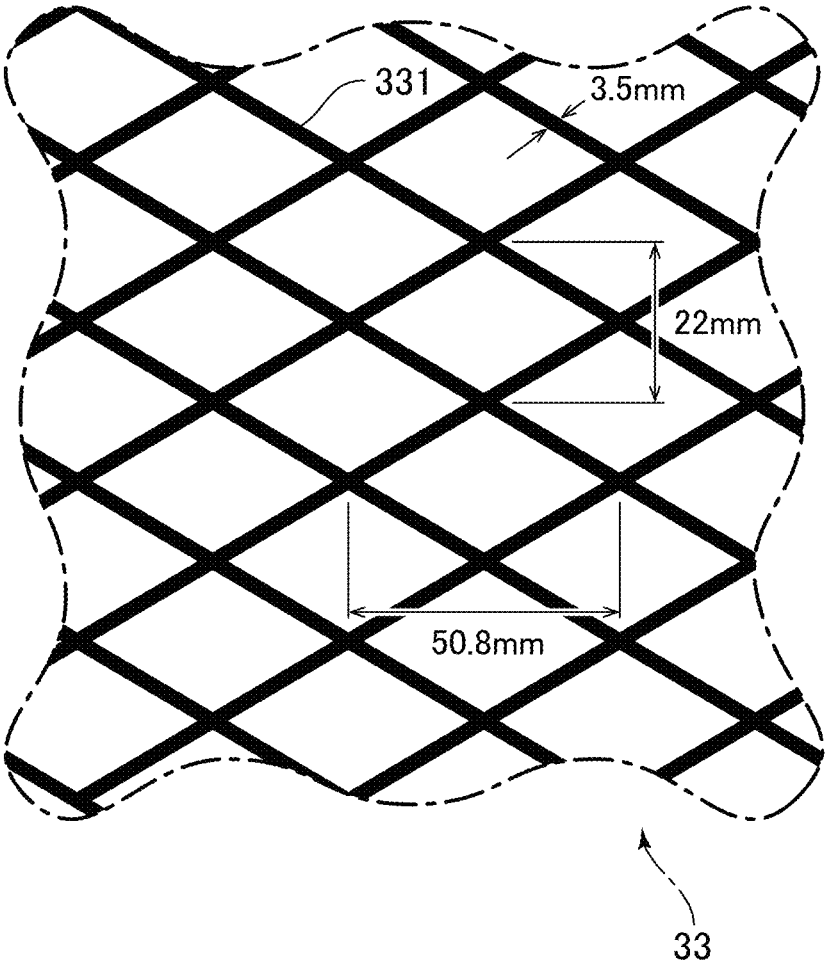
FIG. 4 illustrates an enlarged view of section IV in FIG. 3.

A copper fitting (input part 23) for connecting to the power connection part was attached to the top of the expanded metal (standard SW22, LW50.8, T3.2, W3.5; height 600 mm×width 100 mm; open area percentage 65%) used as the electrification part 33, and copper rods coated with styrene-based butadiene rubber (diameter 5 mm, cross-sectional area 19.6 $mm^2$) were attached to its side as the support part 43 to manufacture the mesh-type anode for electroplating (with frame) of Example 2 illustrated in FIG. 3. An enlarged view of the expanded metal part (section IV in FIG. 3) is illustrated in FIG. 4. Each of these branched paths functions as a current path.

Test Example 2

An electrolytic cell containing an electrolyte with the composition listed in Table 4 was equipped with the anode for electroplating of Example 2, installed along the wall of the electrolytic cell so that the lower 500 mm portion of the expanded metal, the electrification part, was immersed in the electrolyte (the outer shape area of the immersed part of the anode is 5 $dm^2$).

TABLE 4

| Composition of Electrolyte | |
|---|---|
| Component | Concentration |
| ZnO | 10 g/L (8 g/L as Zn ions) |

TABLE 4-continued

| Composition of Electrolyte | |
|---|---|
| Component | Concentration |
| $NiSO_4 \cdot 6H_2O$ | 7.3 g/L (1.6 g/L as Ni ions) |
| Caustic Soda | 130 g/L |
| IZ-250YB*3 | 60 g/L |
| IZ-250YR1*4 | 0.6 mL/L |
| IZ-250YR2*5 | 0.5 mL/L |

*3Amine-based chelating agent manufactured by DIPSOL CHEMICALS CO., LTD. (ethylene oxide adduct of alkylene amine)

*4Brightener manufactured by DIPSOL CHEMICALS CO., LTD. (polyamine)

*5Brightener manufactured by DIPSOL CHEMICALS CO., LTD. (quaternary ammonium salt of nicotinic acid)

Figure 5:
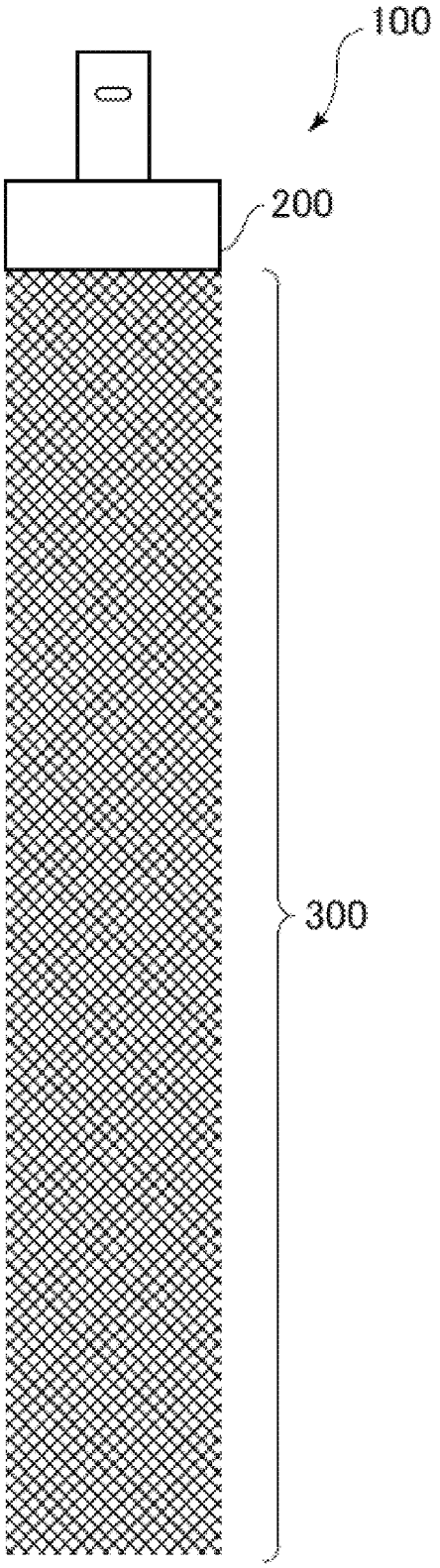
FIG. 5 illustrates an anode for electroplating for comparison.

Similarly to the anode for electroplating of Example 2, but without attaching the copper rods, an anode for electroplating (without frame) of Comparative Example 3 illustrated in FIG. 5 was manufactured and installed in the electrolytic cell in the same manner as the anode for electroplating of Example 2. Then, SPHC-P acid-washed steel plates with a width of 100 mm were installed as cathodes in each electrolytic cell, similarly to the anode, so that the lower 500 mm portion is immersed (electrode distance 30 cm), and the current value was gradually increased from 25 A to 150 A, electrifying for 5 minutes at each current value under the conditions listed in Table 5. During electrification, the electrolytic cell was placed in a larger water tank, and the surroundings of the electrolytic cell were cooled with cooling water and a cooler to maintain the bath temperature.

TABLE 5

| Electrification Conditions | |
|---|---|
| Item | Value |
| Current Value [A] | about 25 to about 150 |
| Bath Volume [L] | 90 |
| Bath Temperature [° C.] | 25 |

The anodic current density at each current value was calculated, and the bath voltage was measured. The results are presented in Table 6.

TABLE 6

| Transition of Bath Voltage | | | | | | | |
|---|---|---|---|---|---|---|---|
| Current value [A] | 25 | 50 | 75 | 100 | 125 | 141 | 150 |
| Anodic Current Density [A/dm$^2$] | 14 | 29 | 43 | 57 | 71 | 81 | 86 |
| Bath Voltage [V] | | | | | | | |
| Comparative Example 3 | 4.98 | 7.23 | 9.72 | 12.12 | 14.27 | 15.71 | — |
| Example 2 | 4.55 | 6.79 | 8.98 | 11.1 | 13.2 | 14.51 | 15.34 |

When using the anode of Comparative Example 3 without a frame, the bath voltage increased with each increase in current value, and it was not possible to electrify under the condition of 150 A because the voltage reached the upper limit of the test equipment before reaching 150 A. On the other hand, when using the anode of Example 2 with a frame, the rise in bath voltage was suppressed. Therefore, providing a support part connecting the electrification part and the electrode connection part in the anode for electroplating suppresses the rise in bath voltage.

Manufacturing Example 3

A U-shaped iron frame (height 200 mm×width 80 mm (inner width 70 mm), cross-sectional area 19.6 mm$^2$) with the bottom open was used as the support part, and 6 iron wires (diameter 2.5 mm) were attached horizontally (in a ladder-like manner) at intervals of 35-36 mm (the distance from the first to the sixth wire is 179 mm). A member (input part) to be in contact with the power connection part was attached to the top of the iron frame. Then, only the iron frame part was coated with a masking paint MR-54 (manufactured by TOKAN Corporation Co., Ltd.) containing styrene-based butadiene rubber (insulating material) to manufacture the anode for electroplating of Example 3. This anode electrifies through the iron wire part (electrification part; width 70 mm), and when installed along the wall of the electrolytic cell so that the entire anode is immersed in the electrolyte, the area of the portion in contact with the solution (the surface area of the iron wire excluding the wall side: Sc) is calculated to be 0.16 dm$^2$ (=0.025 dm×3.14×0.7 dm×½×6). On the other hand, since the outer shape area of the portion in contact with the solution of this anode (the outer shape area of the region where the iron wires are located: So) is calculated to be 1.253 dm$^2$ (=1.79 dm×0.7 dm), Sc/So is calculated to be 0.13. Also, the ratio ($S_2/S_1$) of the cross-sectional area ($S_2$) of the iron wire in the direction of current flow to the cross-sectional area ($S_1$) of the iron frame is calculated to be 0.25.

Test Example 3

An electrolytic cell containing an electrolyte (plating solution) with the composition listed in Table 7 was equipped with the anode for electroplating of Example 3, installed along the wall of the electrolytic cell so that the entire iron wire, the electrification part, was immersed in the electrolyte.

TABLE 7

| Composition of the Electrolyte (Plating Solution) | |
|---|---|
| Component | Concentration |
| ZnO | 10 g/L (8 g/L as Zn ions) |
| $NiSO_4 \cdot 6H_2O$ | 3.7 g/L (0.8 g/L as Ni ions) |

TABLE 7-continued

| Composition of the Electrolyte (Plating Solution) | |
|---|---|
| Component | Concentration |
| Caustic Soda | 130 g/L |
| Amine-based Chelating Agent*6 | 9 g/L |
| Nitrogen-containing Heterocyclic Compound-based Brightener*7 | 0.5 g/L |

*6Manufactured by DIPSOL CHEMICALS CO., LTD.
*7Manufactured by DIPSOL CHEMICALS CO., LTD.

Similarly to the anode for electroplating of Example 3, an iron plate with the same outer shape area (height 179 mm×width 70 mm; both outer shape area and the area of the portion in contact with the solution were 1.253 dm$^2$) as that of the anode was installed in the electrolytic cell as the anode of Comparative Example 4. Then, SPCC steel plates were installed as cathodes in each electrolytic cell, and electrification was performed under the conditions listed in Table 8. The cathode was replaced every hour until the electrification amount for the plating solution reached 100 Ah/L. Also, $NiSO_4 \cdot 6H_2O$ was replenished at a rate of 200 g/kAh, and as for the amine-based chelating agent and the nitrogen-containing heterocyclic compound-based brightener, at 50 Ah/L and 100 Ah/L of electrification, the plating solution was analyzed by high-performance liquid chromatography or capillary electrophoresis each, and these organic compound additives were replenished so as to maintain their concentrations at the start of electrification. Zinc ions were replenished by immersing metallic zinc in the plating solution every hour, titration analysis was performed, and the concentration at the start of electrification was maintained. Note that during electrification, the electrolytic cell was placed in a larger water tank, and the surroundings of the electrolytic cell were cooled with cooling water and a cooler to maintain the bath temperature.

TABLE 8

| Electrification Conditions | |
|---|---|
| Item | Value |
| Current Value [A] | 10 |
| Anodic Current Density [A/dm$^2$] | Example 3: 61<br>Comparative Example 4: 8 |
| Bath Volume [L] | 1.5 |
| Bath Temperature [° C.] | 25 |

At 50 Ah/L and 100 Ah/L of electrification, the appearance of the plating solution was visually observed, the concentration of oxalic acid in the plating solution was measured by ion chromatography, and the concentration of sodium carbonate ($Na_2CO_3$) in the plating solution was measured by titration.

Furthermore, the plating solution before electrification or the plating solution after 100 Ah/L of electrification was used to conduct the Hull Cell test (Hull Cell long type). Briefly, the Hull Cell test was performed by placing 500 mL of the plating solution before or after electrification into a long cell for the Hull Cell test (anode iron plate: 65×65×0.5 mm, cathode iron plate: 65×200×0.5 mm), and plating was conducted under the conditions of 2 A for 20 minutes at 25° C. After plating, the cathode was removed, and its appearance was visually observed. Then, the plating film thickness at every 1 cm from the left end of the cathode plate (high current density side end) and the Ni co-deposition rate were measured by a fluorescence X-ray analyzer.

Figure 6:
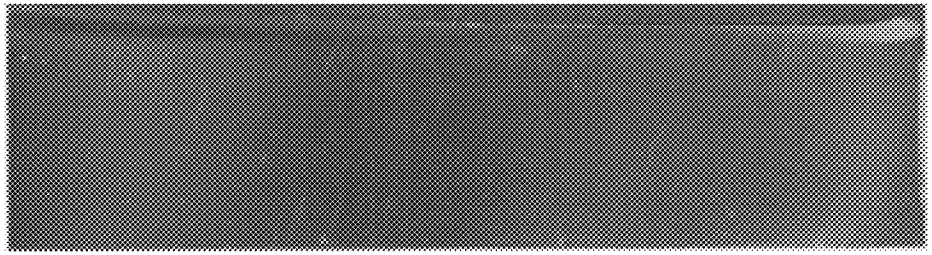
FIG. 6 illustrates the plating appearance of a cathode plate.
Figure 6:
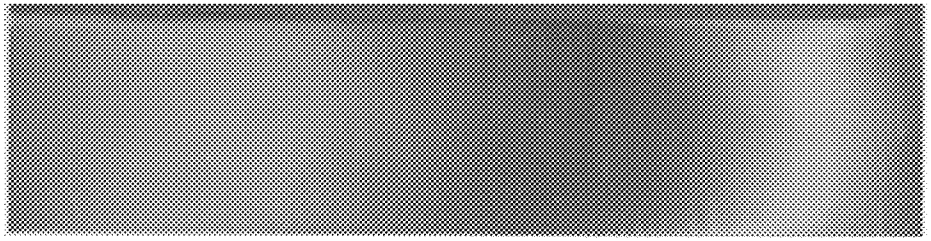
Figure 6:
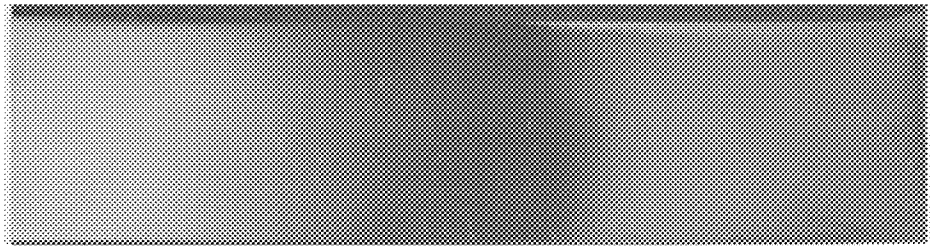

The concentrations of oxalic acid and sodium carbonate are presented in Table 9, photos of the appearance of the cathode after the Hull Cell test are illustrated in FIG. 6, and the plating film thickness and nickel co-deposition rate are presented in Tables 10 and 11, respectively.

TABLE 9

Transition of Concentrations of Oxalic Acid and Sodium Carbonate

| | Electrification Amount [Ah/L] | | |
|---|---|---|---|
| | 0 (Initial) | 50 | 100 |
| Oxalic Acid [g/L] | | | |
| Example 3 | 0.008 | 0.092 | 0.2 |
| Comparative Example 4 | 0.008 | 0.6 | 1.2 |
| Sodium Carbonate [g/L] | | | |
| Example 3 | 19.3 | 24.8 | 26.5 |
| Comparative Example 4 | 19.3 | 28.1 | 31.3 |

TABLE 10

Comparison of Plating Film Thickness According to Distance from High Current Density Side End

| Distance (cm) | 1 | 2 | 3 | 5 | 7 | 9 | 11 | 13 | 15 | 17 | 19 |
|---|---|---|---|---|---|---|---|---|---|---|---|
| Plating Film Thickness (μm) | | | | | | | | | | | |
| Plating Solution Before Electrification | 13.7 | 11.2 | 9.4 | 6.1 | 3.6 | 2.1 | 1.1 | 0.5 | 0.4 | 0.3 | 0.3 |
| Plating Solution After Electrification | | | | | | | | | | | |
| Example 3 | 13.4 | 11.3 | 9.5 | 6.3 | 3.7 | 2.0 | 1.1 | 0.7 | 0.5 | 0.4 | 0.3 |
| Comparative Example 4 | 12.9 | 10.1 | 8.2 | 5.0 | 3.2 | 2.0 | 1.2 | 0.7 | 0.5 | 0.4 | 0.3 |

TABLE 11

Comparison of Nickel Co-deposition Rate According to Distance from High Current Density Side End

| Distance (cm) | 1 | 2 | 3 | 5 | 7 | 9 | 11 | 13 | 15 | 17 | 19 |
|---|---|---|---|---|---|---|---|---|---|---|---|
| Ni Co-deposition Rate (%) | | | | | | | | | | | |
| Plating Solution Before Electrification | 15.4 | 15.3 | 15.2 | 15.8 | 15.6 | 15.8 | 15.6 | 15.6 | 15.2 | 15.0 | 13.6 |
| Plating Solution After Electrification | | | | | | | | | | | |
| Example 3 | 15.2 | 14.9 | 14.6 | 14.8 | 14.8 | 15.1 | 15.0 | 14.4 | 13.9 | 13.1 | 12.7 |
| Comparative Example 4 | 13.8 | 13.6 | 13.6 | 13.6 | 13.8 | 13.9 | 13.9 | 13.7 | 13.2 | 12.7 | 11.5 |

When using the anode of Comparative Example 4, which consists of a single iron plate, the amount of oxalic acid, a decomposition product of the chelating agent, and sodium carbonate, which is produced by the reaction of carbon dioxide generated by the decomposition of the chelating agent with caustic soda in the plating solution, was higher, and the color of the plating solution changed from blue-purple to brownish as electrification proceeded. On the other hand, when using the anode of Example 3, the generation of oxalic acid and sodium carbonate was less compared to Comparative Example 4, and the initial blue-purple color of the plating solution was maintained even after electrification. These results confirmed that using the anode of Example 3, which uses multiple iron wires as the electrification part to reduce the area of the portion in contact with the solution (electrification part for the plating solution) and is equipped with an insulating-coated frame with a larger cross-sectional area than the iron wires as the support part, suppresses the decomposition of organic compound additives. It was also confirmed that there was no rise in bath voltage.

In Test Example 3, organic compound additives were replenished to maintain their concentrations at the start of electrification, but when using the plating solution after electrification with the anode of Comparative Example 4, the gloss range of the cathode (the black part of the cathode in FIG. 6) was narrower, and the plating film thickness and nickel co-deposition rate were lower (Tables 10 and 11), compared to when using the plating solution after electrification with the anode of Example 3. These results indicate that even if organic compound additives are replenished, the plating performance decreases when decomposition aging products such as oxalic acid and sodium carbonate are generated, but using the anode of Example 3 can suppress such decreases in plating performance and enhance the efficiency of using the plating solution.

Thus, it was found that by providing a pair of support parts between the input part and the electrification part of the anode for electroplating, where the support parts have a larger cross-sectional area than the electrification part and the portions in contact with the plating solution are covered with an insulating material, it is possible to suppress the rise in bath voltage. Such a configuration of the anode for electroplating does not require ancillary facilities or anolyte management, nor does it require expensive or special metals, thereby enabling cost reduction in electroplating.

REFERENCE SIGNS LIST

1 Ladder-type anode for electroplating
21 Input part
31 Electrification part
311 Current path
41 Support part
1A Grid-type anode for electroplating
22 Input part
32 Electrification part
321 Horizontal current path
322 Vertical current path
42 Support part
1B Mesh-type anode for electroplating
23 Input part
33 Electrification part
331 Current path
43 Support part
100 Comparative anode for electroplating
200 Input part
300 Comparative electrification part

What is claimed is:

1. A method for electroplating an article with metal, comprising:
electrifying in a plating bath containing ions of the metal and an organic compound additive,
wherein the plating bath includes the article as a cathode and an anode for electroplating, the anode for electroplating, comprising:
an input part where power is input from a power source;
a pair of support parts that extend in a first direction, are arranged at intervals in a second direction intersecting the first direction, receive power supply from the input part, and whose portions in contact with a plating solution are covered with an insulating material; and
an electrification part that extends in the second direction, one end of which is connected to one of the pair of support parts, the other end of which is connected to the other of the pair of support parts, and receives power supply from the pair of support parts, wherein
the plating bath is an alkaline zinc plating bath or alkaline zinc-nickel alloy plating bath,
the anode further comprises an additional support part directly or indirectly connected to the pair of support parts to constitute part or all of the outer periphery of the anode for electroplating;
the electrification part includes several current paths arranged at intervals in the first direction, and
a cross-sectional area of the electrification part is smaller than that of each of the support parts.

2. A system for electroplating an article with a metal, comprising:
a plating bath containing ions of the metal and an organic compound additive,
wherein the plating bath includes the article as a cathode and an anode for electroplating,
the anode for electroplating, comprising:
an input part where power is input from a power source;
a pair of support parts that extend in a first direction, are arranged at intervals in a second direction intersecting the first direction, receive power supply from the input part, and whose portions in contact with a plating solution are covered with an insulating material; and
an electrification part that extends in the second direction, one end of which is connected to one of the pair of support parts, the other end of which is connected to the other of the pair of support parts, and receives power supply from the pair of support parts,
wherein
the plating bath is an alkaline zinc plating bath or alkaline zinc-nickel alloy plating bath,
the electrification part includes several current paths arranged at intervals in the first direction,
a cross-sectional area of the electrification part is smaller than that of each of the support parts, and
the anode further comprises an additional support part directly or indirectly connected to the pair of support parts to constitute part or all of the outer periphery of the anode for electroplating.

3. The system according to claim 2, wherein a ratio (Sc/So) of an area (Sc) of the portion of the electrification part in contact with the solution to an outer shape area (So) of a region where the electrification part is arranged is 0.05 to 0.5 in the anode for electroplating.

4. The system according to claim 2, wherein a ratio ($S_2/S_1$) of a cross-sectional area ($S_2$) of the electrification part to a cross-sectional area ($S_1$) of each support part is 0.5 or less in the anode for electroplating.

5. The system according to claim 2, wherein the electrification part includes wire, expanded metal, and/or punching metal.

* * * * *